United States Patent [19]

Steimann

[11] 4,107,879

[45] Aug. 22, 1978

[54] DOOR OF THE SELF-LOCKING TYPE

[75] Inventor: Franz Steimann, Gelsenkirchen-Horst, Germany

[73] Assignee: Didier Engineering GmbH., Essen, Germany

[21] Appl. No.: 818,100

[22] Filed: Jul. 21, 1977

[30] Foreign Application Priority Data

Jul. 23, 1976 [DE] Fed. Rep. of Germany ... 7623290[U]

[51] Int. Cl.[2] ..... E05C 21/02

[52] U.S. Cl. ..... 49/465; 202/248

[58] Field of Search ..... 49/465, 463; 202/248, 202/247

[56] References Cited

U.S. PATENT DOCUMENTS

| | | | |
|---|---|---|---|
| 1,780,992 | 11/1930 | Beckers | 202/248 |
| 2,759,884 | 8/1956 | Gillott | 202/248 |
| 3,486,986 | 12/1969 | Freund | 202/248 |
| 3,510,404 | 5/1970 | Freund | 202/248 |
| 3,630,853 | 12/1971 | Grumm | 202/248 |

*Primary Examiner*—Philip C. Kannan

*Attorney, Agent, or Firm*—Wenderoth, Lind & Ponack

[57] ABSTRACT

A door is of the type wherein the weight of the door causes locking thereof against a door frame. The door frame is of the type having extending outwardly therefrom vertically spaced pairs of support hooks for supporting the door. The door includes a door element adapted to be sealed against the door frame. A pair of vertically spaced horizontally extending locking bars are carried by the door element. Each locking bar has opposite round ends adapted to rest on and be held by a respective pair of support hooks. A pair of locking support members, one each associated with a respective locking bar, are mounted for vertical sliding movement along the door element. Each locking bar is pivotally connected to the respective locking support member about a respective horizontal axis such that upon positioning the locking bars on the respective hooks, the weight of the door will cause the locking bars to pivot about the respective pivot axes in directions away from the door element. The door is thereby pressed away from the hooks and toward the door frame. An equalizer assembly is rotatably mounted on the door element and connected to both of the locking support members for equalizing the relative positions of the locking bars with respect to the hooks upon initial positioning of the locking bars on the hooks, by allowing relative movement of the locking support members along the door element in vertical directions toward or away from each other. First rollers mounted on the locking support members for rotation about axes extending parallel to the door element and second rollers mounted on the locking support members for rotation about axes perpendicular to the door element guide the vertical movement of the locking support members. Needle bearings are provided on the opposite ends of the locking bars to prevent friction between the locking bars and the hooks.

7 Claims, 3 Drawing Figures

DOOR OF THE SELF-LOCKING TYPE

BACKGROUND OF THE INVENTION

The present invention relates to an improved door, particularly a coke oven door, of the self-locking type. More particularly, the present invention is directed to such an improved door wherein the weight of the door itself causes locking of the door against a door frame of the type having extending outwardly therefrom vertically spaced pairs of support hooks for supporting the door.

A door of this type is disclosed in German Patent No. 908,608, wherein a door element, adapted to be sealed against a door frame and close a door opening in the door frame, carries a pair of vertically spaced horizontally extending locking bars. Each locking bar has opposite round ends adapted to rest on and be held by a respective pair of support hooks of the door frame. When the door is placed in position with the locking bars positioned on the hooks, the weight of the door causes the locking bars to be pivoted about horizontal axes away from the door element. Thus, the door is pressed against the sealing frame. This known device also includes an arrangement whereby the locking bars are carried by respective locking support members which are guided for vertical movement along the door element by means of angular elements or brackets. Connecting rods attached to the locking support members are hinged on a two-arm lever which is pivoted to the door element to form an equalizer linkage assembly for equalizing contact position of the locking bars with the respective hooks, by allowing relative vertical movement of the locking support members toward or away from each other.

However, this known type of door has certain inherent disadvantages.

Specifically, the locking support members tend to jam in their respective angular brackets due to the heavy weight of the door element and the thus inherent high frictional forces involved. Accordingly, the equalizer linkage mechanism is not always effective to equalize seating or contact of the locking bars with the respective hooks. This causes uneven sealing contact pressure of the door against the door frame.

A further problem involved in the known door disclosed in German Pat. No. 908,608, is that upon relative movement of the rounded ends of the locking bars with respect to the hooks, considerable friction resistance is encountered. This is an additional friction force tending to retard movement of the elements toward a smooth and even door locking position. Furthermore, this frictional resistance requires a greater lifting force to be applied to the door to unlock the door.

An even further disadvantage of the door disclosed in German Pat. No. 908,608 is due to the fact that the equalizer linkage assembly is provided with a turnbuckle and a worm gear to provide for necessary adjustment due to differing lengths of connecting rods connecting the locking support members and the two-arm lever and due to differing vertical spaced positions of the pairs of hooks of the door frame.

SUMMARY OF THE INVENTION

With the above discussion in mind, it is a primary object of the present invention to provide an improved door of the type wherein the weight of the door causes locking of the door against a door frame, but which overcomes all of the above noted disadvantages of known doors of this type, as disclosed in German Pat. No. 908,608.

It is a specific object of the present invention to provide such a door wherein jamming of the locking support members during vertical movement thereof is prevented.

It is an even further object of the present invention to provide such a door wherein frictional resistance caused by engagement between the locking bars and hooks is overcome.

It is a yet further object of the present invention to provide such a door wherein the equalizer linkage assembly thereof may accommodate connecting rods of varying length and may accommodate differing vertical spacings of the door frame hooks, without the need for the expensive turnbuckle and worm gear arrangement necessitated in the device disclosed in German Pat. No. 908,608.

These objects are achieved in accordance with the present invention by the provision of first rollers mounted on the locking support members for rotation about axes extending parallel to the door element and second rollers mounted on the locking support members for rotation about axes perpendicular to the door element. These first and second rollers operate to guide the vertical movement of the locking support members and prevent friction which would otherwise cause jamming of the locking support members. In a specific structural arrangement of this feature, each locking support member has therein a vertically extending slot which receives a vertically extending rail attached to the door element. The second rollers contact and roll on the rails. Thus, the rails operate to laterally guide the locking support members and also to limit the extent of upward and downward vertical movement of the locking support members. Further, each locking support member has extending thereover a substantially U-shaped bracket which is attached to the door element. The first rollers contact and roll on the door element and also on the brackets.

In accordance with a further feature of the present invention, the opposite round ends of each of the locking bars have thereon needle bearings which thus eliminate frictional resistance due to engagement of the locking bars with the hooks.

In accordance with an even further object of the present invention the two-arm lever of the equalizer linkage assembly is in the form of a disk which is rotatably mounted on the door element at a position between the locking support members. The disk has around the periphery thereof a plurality of pairs of circumferentially spaced connections. Accordingly, the connecting rods which are also connected to the locking support members may be connected at different positions on the disk, to thereby accommodate varying lengths of the connecting rods and varying vertical spacing of the door frame hooks.

BRIEF DESCRIPTION OF THE DRAWINGS

Further objects, features and advantages of the present invention will be apparent from the following detailed description of a preferred embodiment thereof, with reference to the attached drawings, wherein.

DETAILED DESCRIPTION OF THE INVENTION

Figure 1:
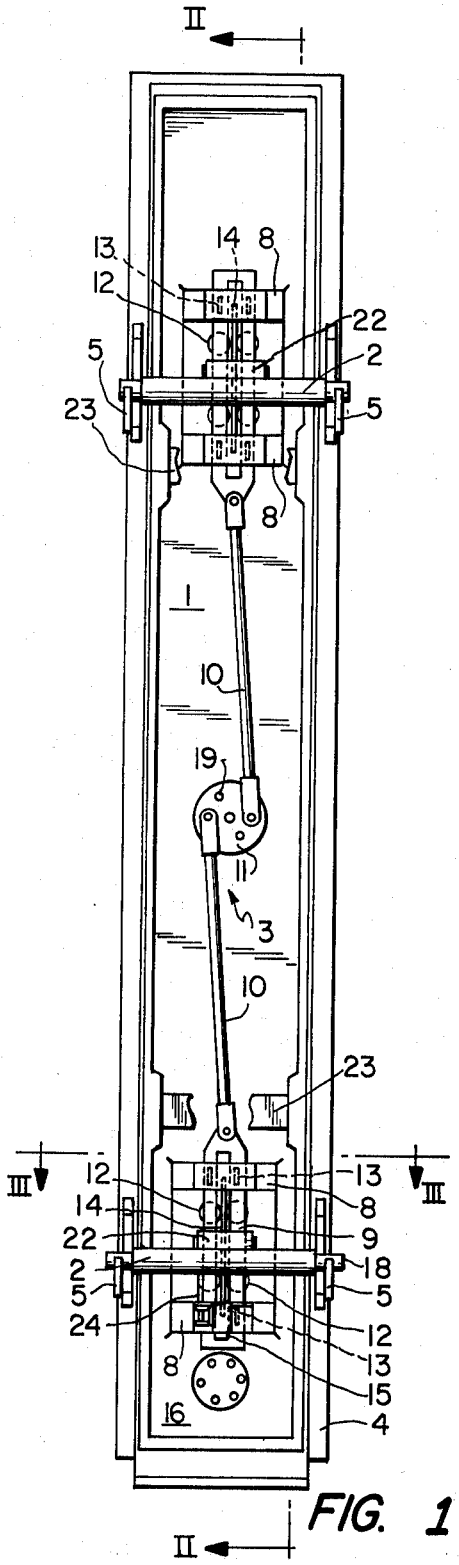
FIG. 1 is a front elevation view of the coke oven door of the present invention.

As mentioned above, the present invention is directed to an improvement in the type of coke oven door and coke oven door locking mechanism disclosed in German Pat. No. 908,608, and the disclosure of such patent is herein incorporated by reference.

A door member 1 of conventional configuration has provided along all of the edges thereof sealing strips 6. When the door is in the closed position, the sealing edges of strips 6 contact in a sealing manner with sealing surfaces 7 of a door frame 4. The door member 1 has on the side thereof facing the interior of the coke oven a conventional lining or plug 21 of refractory material which is attached to door member 1 in a known manner, for example by means of holders 20.

Door frame 4 has attached thereto, at two different vertical levels, pairs of angular hooks 5 which are designed and adapted to support the weight of the door. Each pair of hooks 5 receives and supports a locking bar 2, two such locking bars being provided at vertically spaced positions. Each locking bar 2 has at the opposite ends thereof rounded portions. In accordance with a particular feature of the present invention, the rounded ends of each locking bar are fitted with bearings, such as needle bearings 18 of a conventional construction. Thus, during the locking movement of the door, to be discussed in more detail below, needle bearings 18 absorb the friction which would otherwise occur during relative contact between the rounded ends of the locking bars and the respective surfaces of hooks 5.

Each locking bar 2 has integral therewith extensions **2*a* which extend in a slightly upwardly inclined manner toward door member 1 and which have extending through the ends thereof adjacent door member 1 a rotary pivot or pin 22 which extends in a direction parallel to locking bar 2. Pivot 22 is journaled in an extension 9*a* extending outwardly from an elongated, vertically positioned locking support member 9**.

Member 9 has therein a closed longitudinal, vertically extending slit or slot 15 within which is received a vertically extending runway or rail 14 which is attached to the exterior of door member 1. Rail 14 thus acts as a stop for limiting the upward and downward displacement of member 9.

The structure thus far described is similar to that disclosed in German Pat. No. 908,608. That is, when a conventional door lifting device (not shown) grasps the door by means of conventional brackets 23, and positions the door such that locking bars 2 rest on hooks 5, then when the lifting device is removed, the weight of the door will cause arms **2*a* to achieve a more horizontal position (see particularly FIG. 2) while locking bars are supported and held in place by hooks 5. This horizontal movement will cause the door to be moved toward the door frame (i.e. to the right in FIG. 2) and cause sealing strips 6 to contact sealing surfaces 7 of door frame 4. That is, there will be an outwardly directed force caused by the rounded ends of locking bars 2 against hooks 5, and an inwardly directed force of sealing strips 6 against sealing surfaces 7 of door frame 4**, thereby achieving sealing of the door.

However, as mentioned above, in the type of arrangement disclosed in German Pat. No. 908,608, jamming tends to occur due to friction between contacting surfaces of various of the elements. In accordance with the present invention, a portion of this friction is overcome by providing needle bearings 18 on the rounded ends of locking bars 2.

In accordance with a further feature of the present invention, friction caused by relative movement of members 9 is also overcome. Specifically, each member 9 has attached thereto wheels or rollers 12 which extend in a plane parallel to door member 1 and which thus are rotatable about axes perpendicular to door element 1 and which roll against opposite lateral surfaces of rail 14. Thus, rail 14 acts as a lateral guide during movement of member 9. Additionally, each member 9 has attached thereto wheels or rollers 13 which extend in planes perpendicular to door element 1 and which thus rotate about axes parallel to door element 1. Rollers 13 roll against an outer surface 16 of door element 1 and also against an inner surface of a substantially U-shaped bracket or guide 8 which is attached to door element 1. Thus, the vertical movement of member 9 with respect to door element 1 is guided by rail 14 and bracket 8, and the friction of such movement is obviated by the provision of rollers 12 and 13.

In the illustrated embodiment, rollers 12 and 13 are shown as being mounted within and extending through opposite vertical arms of member 9 as defined by slit 15. However, it will be understood by those skilled in the art that rollers 12 and 13 could similarly be attached to and mounted on respective surfaces of member 9. Furthermore, in the illustrated embodiment there are shown two vertically spaced pairs of rollers 12 and two vertically spaced pairs of rollers 13. It will be understood however that any other convenient number and arrangement of rollers 12 and 13 could be employed, as long as relatively friction free movement of member 9 with respect to door element 1 is achieved.

Furthermore, it is to be understood that the relative manner of connection of each locking bar 2 to the respective member 9 may be other than that specifically described and illustrated. Specifically, such connection may be in the manner disclosed in German Pat. No. 908,608.

As will be apparent from the drawings, the two vertically spaced assemblies each including a locking bar 2, a member 9 and the structure associated therewith are substantially identical.

Further, each member 9 has hingedly or pivotably attached thereto a connecting rod 10. Specifically, lower member 9 has attached to the upper end thereof a respective connecting rod 10, and upper member 9 has attached to the lower end thereof a respective connecting rod 10. The free ends of the two connecting rods 10 are hingedly or pivotably connected to a circular disk 11 which is rotatably or pivotably mounted to door element 1. The assembly of disk 11 and rods 10 forms an equalizer linkage assembly 3 which performs the function disclosed in German Pat. No. 908,608, i.e. that of equalizing the door locking mechanism. Specifically, when the door is initially positioned such that the rounded ends of locking bars 2 rest on respective hooks 5, if one of the locking bars 2 engages the respective hooks 5 before the other locking bar 2 engages its respective hooks 5, without the equalizer linkage mechanism 3, uneven sealing of the door would occur. However, by using the equalizer linkage mechanism 3, when such uneven positioning occurs, that locking bar which first contacts its respective hooks 5 will be allowed to move without moving the door element into a sealing position by virtue of the respective members 9, rods 10 and disk 11. More particularly, and with reference to FIG. 2 of the drawings, assume that lower locking bar 2 contacts lower hooks 5 before upper locking bar 2 contacts upper hooks 5. There will thus be an upper force exerted on lower locking bar 2, and this force will be transferred via arms 2*a* and pivot 22 to lower member 9 which will slide upwardly. Thus, lower rod 10 will move upwardly, causing disk 11 to rotate in a clockwise direction with respect to FIG. 1. This will accordingly pull upper rod 10, upper member 9, and upper locking bar 2 downwardly into contact with upper hooks 5. Accordingly, this equalizer linkage mechanism will enable both locking bars 2 to be seated on their respective hooks 5 before the weight of the door causes the door to be locked.

During this equalization, members 9 are allowed to freely move due to the provision of rollers 12 and 13.

After such equalization, members 9 perform no further movement with respect to door element 1. Rather, the weight of the door will cause pivots 22 to be moved downwardly with respect to their respective locking bars 2, thereby causing arms 2*a* to assume a more horizontal position. This action will cause the door element 1 to be pressed toward the oven chamber and accordingly will cause sealing strips 6 to be pressed with equal pressure against sealing surfaces 7 of door frame 4.

This locking movement will not be retarded by friction between the rounded ends of the locking bars and the respective hooks 5, due to the provision of roller bearings 18.

Figure 2:
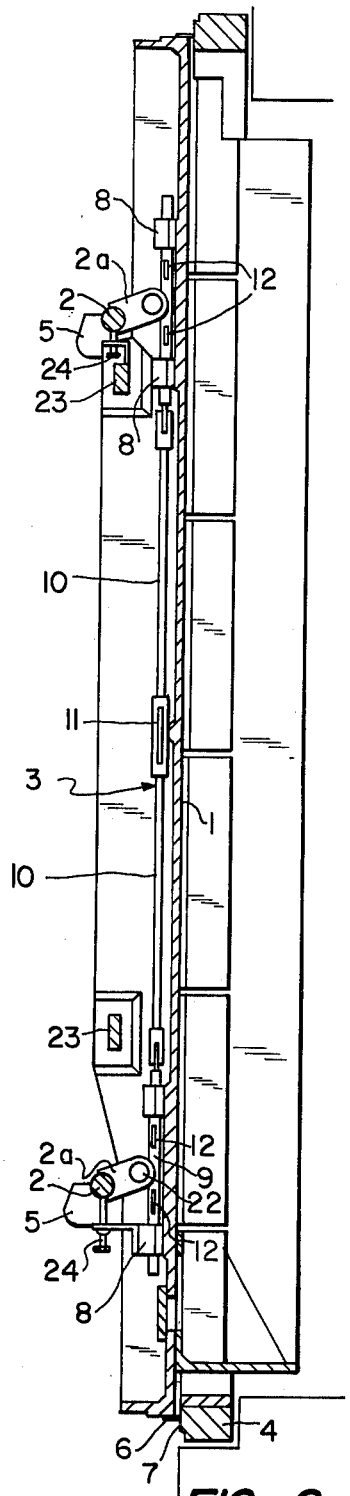
FIG. 2 is a longitudinal section of the coke oven door, taken along line II—II of FIG. 1.
Figure 3:
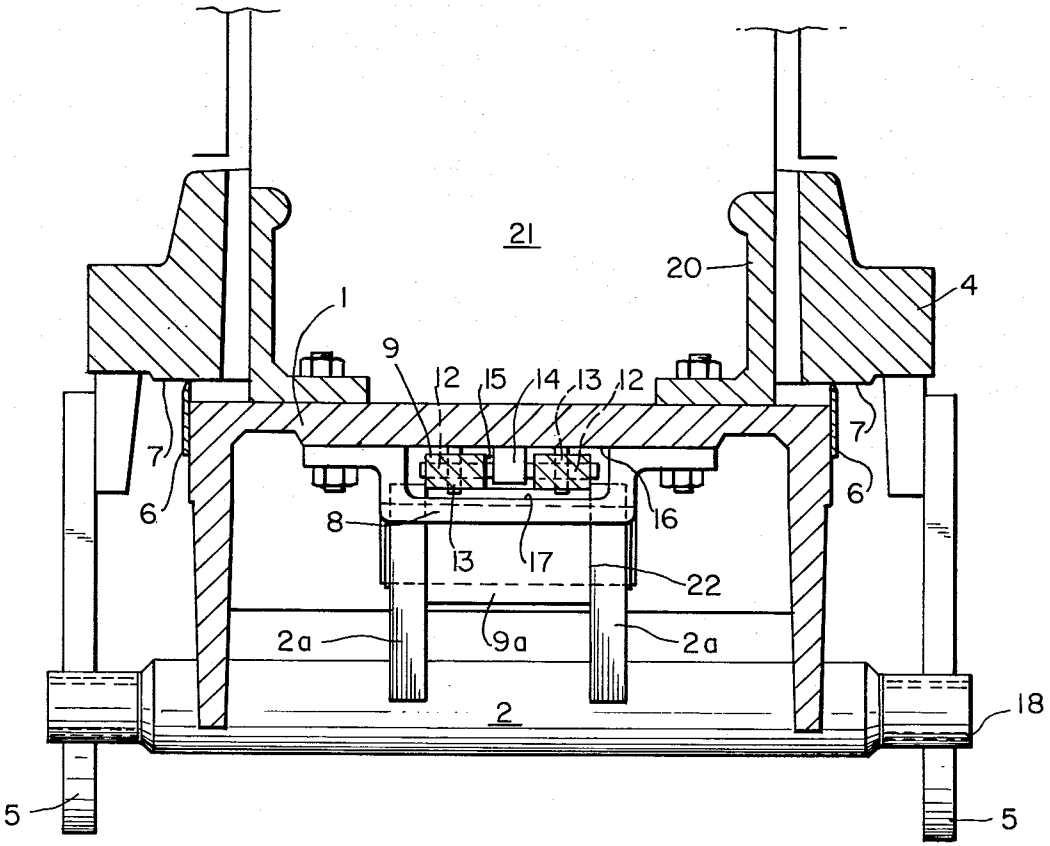
FIG. 3 is a cross-section of the coke oven door, taken along line III—III of FIG. 1.

During unlocking and removal of the door, by use of a conventional door lifting device (not shown) locking bars 2 and arms 2*a* pivot downwardly or in a counterclockwise direction as viewed in FIG. 2 of the drawings, whereby the door element 1 is moved away from sealing engagement.

In further accordance with the present invention, disk 11 may have provided therein a plurality of holes 19 so that rods 10 of different lengths may be employed, or so that the assembly is applicable to door frames having hooks 5 spaced apart by varying distances. This arrangement is specifically an improvement over the arrangement in German Pat. No. 908,608 wherein such size and positioning adjustments are compensated for by a relatively expensive assembly of a turnbuckle and worm gear.

In accordance with a still further feature of the present invention, when the door is in the lifted position, i.e. such that locking bars 2 are not positioned on hooks 5, the lowermost positions of locking bars 2 may be limited or defined by means of rests or support members 24 which may be suitably mounted on the door element, for example on brackets 8, as shown in the drawings. Also, to provide for varying the relative angular positions of locking bars 2 when the door is not supported on hooks 5, supports 24 may be vertically adjustably mounted.

It will be apparent that various modifications of the above specifically described structural arrangements may be made without departing from the scope of the present invention.

What is claimed is:

1. A door of the type wherein the weight of the door causes locking thereof against a door frame of the type having extending outwardly therefrom vertically spaced pairs of support hooks for supporting the door, said door comprising:

a door element adapted to be sealed against a door frame and close a door opening therein;

a pair of vertically spaced, horizontally extending locking bars carried by said door element, each said locking bar having opposite round ends adapted to rest on and be held by a respective pair of support hooks of the door frame;

a pair of locking support members, one each associated with a respective one of said locking bars, said locking support members being mounted for vertical sliding movement along said door element, each said locking support member having therein an elongated vertically extending slot;

means for pivotally connecting each said locking bar to the respective said locking support member about a respective horizontal axis, such that upon positioning said locking bars on the respective support hooks, the weight of the door will cause said locking bars to pivot about the respective said pivot axes in directions away from said door element, thereby pressing said door in a direction away from the hooks and toward the door frame;

equalizer linkage means, rotatably mounted on said door element and connected to both of said locking support members, for equalizing the relative positions of said locking bars with respect to the hooks upon initial positioning thereon of said locking bars, by allowing relative movement of said locking support members along said door element in vertical directions toward or away from each other;

a pair of vertically extending rails attached to said door element, one each of said rails extending into a respective one of said slots; and means for guiding the vertical movement of said locking support members, said guiding means comprising first rollers mounted on said locking support members for rotation about axes extending parallel to said door element and second rollers mounted on said locking support members for rotation about axes perpendicular to said door element, said second rollers contacting and rolling on said rails.

2. A door as claimed in claim 1, wherein said equalizer linkage means comprises a disk rotatably mounted on said door element at a position between said locking support members, and a pair of connecting rods, one each connected to a respective of said locking support members and to said disk.

3. A door as claimed in claim 2, wherein said disk has therein a plurality of pairs of circumferentially spaced connecting positions for connection with said connecting rods.

4. A door as claimed in claim 1, further comprising a pair of substantially U-shaped brackets, one each attached to said door element at a position to extend over a respective one of said locking support members, said locking support members thus being spaced between said door element and the respective said brackets, and wherein said first rollers contact and roll on said door element and surfaces of said brackets.

5. A door as claimed in claim 1, further comprising a pair of substantially U-shaped brackets, one each attached to said door element at a position to extend over a respective one of said locking support members, said locking support members thus being spaced between said door element and the respective said brackets, and wherein said first rollers contact and roll on said door element and surfaces of said brackets.

6. A door as claimed in claim 1, further comprising means, positioned on said opposite round ends of said locking bars, for preventing friction between said locking bars and the hooks.

7. A door as claimed in claim 6, wherein said friction preventing means comprises needle bearings.

* * * * *